US007843352B2

(12) United States Patent
Hansen et al.

(10) Patent No.: US 7,843,352 B2
(45) Date of Patent: Nov. 30, 2010

(54) IGNITION-SOURCE DETECTING SYSTEM AND ASSOCIATED METHODS

(75) Inventors: Povl Hansen, Hobro (DK); Geof Brazier, Woodbury, MN (US)

(73) Assignee: B&S Safety Systems, Inc., Limerick (IE)

( * ) Notice: Subject to any disclaimer, the term of this patent is extended or adjusted under 35 U.S.C. 154(b) by 290 days.

(21) Appl. No.: 12/068,956

(22) Filed: Feb. 13, 2008
(Under 37 CFR 1.47)

(65) Prior Publication Data

US 2009/0189773 A1 Jul. 30, 2009

Related U.S. Application Data

(60) Provisional application No. 60/900,970, filed on Feb. 13, 2007, provisional application No. 60/901,087, filed on Feb. 14, 2007.

(51) Int. Cl.
*G08B 17/12* (2006.01)

(52) U.S. Cl. ..... 340/577; 250/339.15

(58) Field of Classification Search ..... 340/577, 340/578; 250/339.14, 339.15, 554
See application file for complete search history.

(56) References Cited

U.S. PATENT DOCUMENTS 4,453,159 A * 6/1984 Huff et al. ..... 340/590
4,725,733 A * 2/1988 Horman et al. ..... 250/339.14
5,052,494 A 10/1991 Larsen
5,726,632 A * 3/1998 Barnes et al. ..... 340/577
6,013,919 A * 1/2000 Schneider et al. ..... 250/554
6,057,549 A 5/2000 Castleman
6,078,269 A * 6/2000 Markwell et al. ..... 340/577
6,598,454 B2 7/2003 Brazier et al.
6,829,513 B2 * 12/2004 Piersanti et al. ..... 340/577
6,843,098 B2 1/2005 Brazier et al.
7,051,570 B2 5/2006 Brazier et al.
2004/0089810 A1 * 5/2004 Brown et al. ..... 250/339.15
2005/0252663 A1 11/2005 Olson et al.

FOREIGN PATENT DOCUMENTS

WO WO 2005/091238 A2 9/2005

OTHER PUBLICATIONS

International Search Report for PCT/US2008/001873 dated as mailed on Oct. 23, 2008 (8 pages).
PCT Search Report for PCT/US2008/001873 dated as mailed on Jan. 16, 2009 (21 pages).

* cited by examiner

*Primary Examiner*—John A Tweel, Jr.
(74) *Attorney, Agent, or Firm*—Finnegan, Henderson, Farabow, Garrett & Dunner, L.L.P.

(57) ABSTRACT

A system of ignition-source detection and prevention in containers and open materials handling systems. The system includes an electronic processor located in close proximity to a detector, a spray nozzle, and a valve. The electronic processor may be configured to be placed in a dust-hazard environment. The detector may be configured to detect radiation and/or a flame. Associate methods are also disclosed, including: a method of responding to an ignition source, a method of installing an ignition-source detection system, and a method of testing an ignition-source detection system.

70 Claims, 7 Drawing Sheets

IGNITION-SOURCE DETECTING SYSTEM AND ASSOCIATED METHODS

CROSS-REFERENCE TO RELATED APPLICATIONS

This application claims the benefit of U.S. Provisional Application No. 60/900,970, filed Feb. 13, 2007, by Povl Hansen and Geoff Brazier and titled IMPROVED IGNITION-SOURCE DETECTING SYSTEM AND ASSOCIATED METHODS, the disclosure of which is expressly incorporated herein by reference. This application also claims the benefit of U.S. Provisional Application No. 60/901,087, filed Feb. 14, 2007, by Povl Hansen and Geoff Brazier and titled IMPROVED IGNITION-SOURCE DETECTING SYSTEM AND ASSOCIATED METHODS, the disclosure of which is expressly incorporated herein by reference.

TECHNICAL FIELD

The present invention relates to systems of ignition-source detection and prevention. More specifically, the present invention relates to detecting potential ignition sources in containers and open materials handling systems.

BACKGROUND

Fires or explosions can result when ignition sources—such as sparks, embers, hot process material, or bits of heated metal—are found within closed containers. Dust explosions and fires, for example, are relatively common in various industries. To create such an explosion, an ignition source causes a fuel, like fine dust particles, dispersed in a container to explode. Dust explosions can occur in a variety of containers, including dust collectors, air filters, pneumatic conveyors, ducts, pipelines, and other confined spaces commonly encountered in industrial sites.

Ignition sources may result from, for example, industrial or manufacturing processes occurring at the location of the fire or explosion. Abrasive grinding, cutting, welding operations, and electrostatic discharge, among many others, may result in sparks or embers capable of igniting suspended particles in a container.

Ignition sources may result from material handling systems, such as conveyors, which may be enclosed or open to the atmosphere moving bulk material that may contain hot material from one process to a storage point.

Conventional ignition-source detecting systems typically employ one or more detectors connected to a centralized control unit, located, for example, in a manufacturing facility's control room. The control unit typically is connected to one or more valves for controlling the release of water, carbon dioxide, another fluid intended to prevent ignition, or another safety mechanism such as a diverter valve.

Conventional ignition-source detection systems typically use a combined controller and monitor with hard wiring running from each detector and spray nozzle (or other device) back to this combined unit. Such systems have a limited capacity regarding how many applications of ignition-source detection activity they can support. Frequently, the limited number of connection points included in conventional ignition-source detection hardware limits the ability to add ignition-source detection points to a process. When this occurs, the combined controller and monitor must be replaced with a larger capacity unit or a separate independent system. Either way, the combined controller and monitor limits flexibility.

Typically, conventional ignition-source detection systems are limited to between four and sixteen detection and extinguishing points.

Running the wires necessary to connect the detectors to the control unit is costly. Moreover, electromagnetic radiation, temperature differences, and other factors may jeopardize communications between the control unit and the attached sensors and spray nozzles. Accordingly, testing and maintenance of the wires is needed to ensure the proper functioning of the ignition-source detecting system. The wires necessitated by such conventional systems are costly to install, test, and maintain.

The control units of conventional ignition-source detecting systems depend on mechanical or solid state relays to identify and counteract ignition sources in containers. To change or customize such a control unit requires rewiring its constituent components. Accordingly, the rigid electrical design of conventional ignition-source detecting systems hampers customization and leads to increased expense and reduced flexibility of application.

In conventional ignition-source detecting systems, the control unit is disposed at a location remote from the container being monitored. Typically, the control unit resides in a climate-controlled location to prevent exposure to fluctuating temperatures and dusty conditions. For example, conventional ignition-source detection systems typically require the combined controller and monitor to be in a lower hazard level dusty environment, such as ATEX Zone 22, Class 2 Division 2 or unrated environment.

Typically, a single combined controller and monitor is attached to conventional ignition-source detecting systems. This forces all control and monitoring activity to take place in one location, typically located far from the monitored container.

In cold climates where water is used to prevent ignition, conventional ignition-source detecting systems include a heat tracing circuit to ensure that the water does not freeze. Such heat tracing circuits typically employ electricity to generate necessary heat. Conventionally, ignition-source detecting systems do not monitor the supply of electricity to such heat tracing circuits.

The detectors included in conventional ignition-source detecting systems are not capable of creating a direct digital signal in response to observed infrared radiation. Accordingly, such detectors either output an analog signal or require an analog-to-digital converter to communicate with digital control systems. An analog signal may output a variable voltage or current in response to the level of radiation detected. The analog output must then be interpreted by a controller to determine an appropriate system response.

Detectors in conventional ignition-source detecting systems typically are not configured to detect flames. Instead, conventional systems focus on detecting sparks and embers only. Flame detection has historically been tackled in a manner different than the detection of sparks and embers. To the extent that conventional ignition-source detecting systems detect flames as well as sparks and embers, they include separate detectors for detecting flames and for detecting other ignition sources.

Conventional detectors do not allow for sensitivity adjustment. They either require calibration prior to installation or cannot be adjusted at all. It is desirable to allow sensitivity adjustment before, after, or during use or installation.

It is desirable to provide systems and methods for enhancing conventional ignition-source detection systems to overcome the limitations described above.

SUMMARY

A system consistent with one embodiment of the disclosure provides an ignition-source detecting system comprising an electronic processor and a detector. The detector of this ignition-source detecting system detects radiation in a container. The electronic processor is located in close proximity to the container and the detector.

According to another embodiment, a method of installing an ignition-source detecting system comprises locating an electronic processor in close proximity to a container. A detector is mounted on the container. The detector is configured to detect radiation in a container. The electronic processor and detector are connected via dedicated wires.

In another embodiment, an ignition-source detecting system comprises a detector for detecting radiation and an electronic processor for controlling the ignition-source detecting system. According to this embodiment, the electronic processor and detector are designed for positioning in an ATEX Zone 21 or Class 2, Division 1 location.

According to a further embodiment, a method of responding to an ignition source comprises detecting a source of radiation in a container and sending a digital signal to an electronic processor. The electronic processor is located in close proximity to the container. The method includes sending a signal from the electronic processor to a valve and actuating the valve to release fluid through a spray nozzle.

In yet another embodiment, a method of testing an ignition-source detecting system comprises generating a first test signal from the light emitting diode (LED). The LED is integral with a detector. The method may also include detecting the first test signal at a detector, sending a second signal to a processor, and disregarding the second signal.

It is to be understood that both the foregoing general description and the following detailed description are exemplary and explanatory only and are not restrictive of the invention as claimed.

The accompanying drawings, which are incorporated in and constitute a part of this specification, illustrate several embodiments consistent with the invention and together with the description, serve to explain the principles of the invention.

DESCRIPTION OF THE EMBODIMENTS

Reference will now be made in detail to the exemplary embodiments consistent with the invention, examples of which are illustrated in the accompanying drawings.

Figure 1:
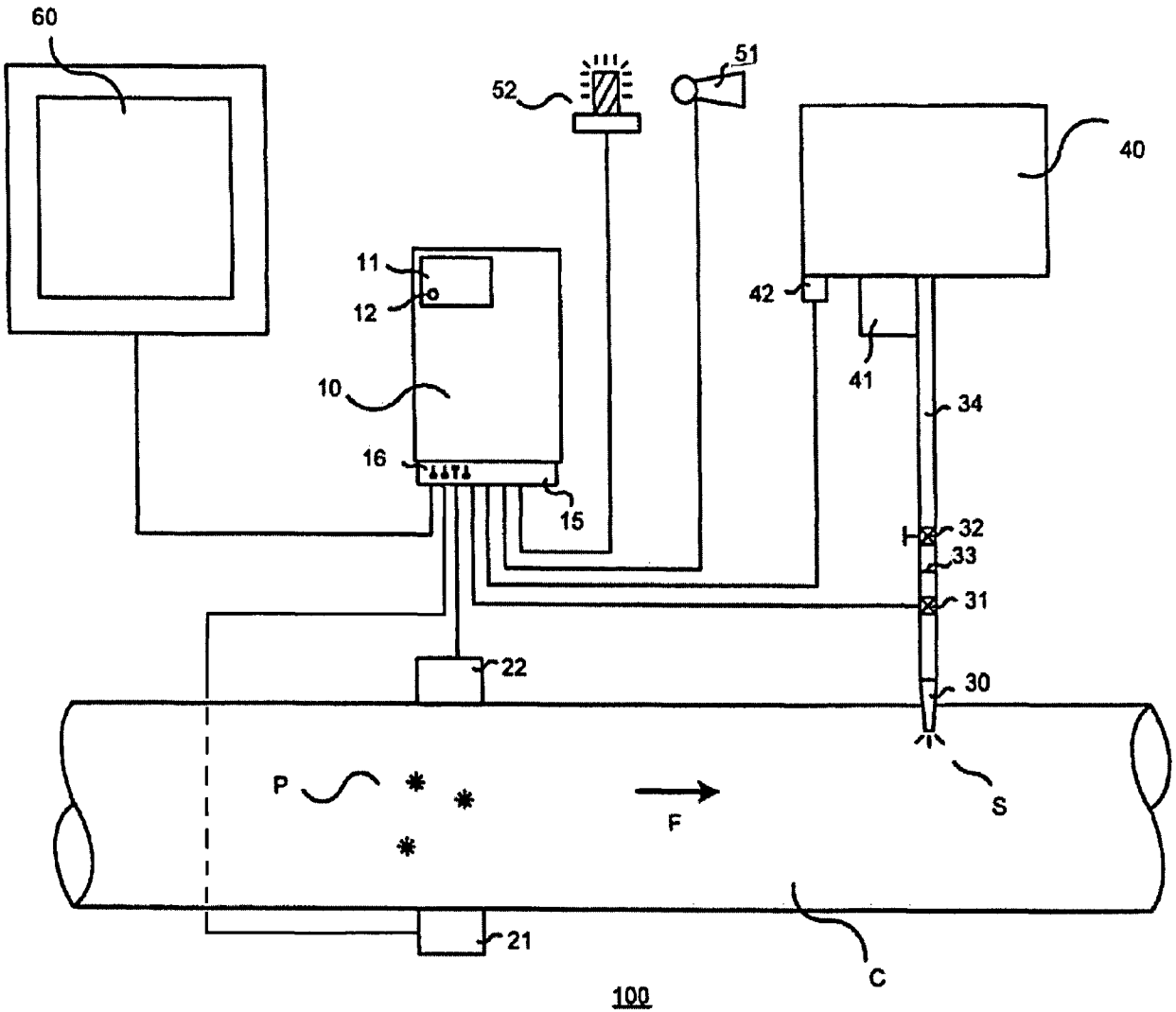
FIG. 1 is a schematic diagram of an ignition-source detecting system according to an exemplary embodiment.

FIG. 1 illustrates an exemplary ignition-source detecting system 100. The ignition-source detecting system pictured in FIG. 1 comprises an electronic processor 10, a first detector 21, a second detector 22, a spray nozzle 30, and a valve 31. Detectors 21, 22 are mounted directly on container C, which contains particles P. Electronic processor 10 may also connect to a monitor 60, an audible alarm 51, and a visual alarm 52. Although only two detectors 21, 22 are shown in FIG. 1, other embodiments of the system may include any suitable number of detectors. In an embodiment where the ignition-source detection system 100 includes two or more detectors 21, 22, each detector may operate as a self-contained module. In that embodiment, if one of ignition-source detectors 21 or 22 fails, the failure does not affect the other ignition-source detectors in system 100.

Although in FIG. 1 detectors 21 and 22 are drawn opposing each other on a generally circular duct, in other embodiments they may be installed other than diametrically opposite one another. In one embodiment, detectors 21 and 22 may be mounted approximately 20 cm/8 inches from each other along an axis of container C. In another embodiment, detectors 21 and 22 may be mounted on container C radii having a minor angle of approximately 160 degrees between the two detectors 21, 22 in order to maximize sensitivity to particles P in container C.

During operation of ignition-source detecting system 100, electronic processor 10 sends and receives signals to and from the other system components, including detectors 21 and 22. In one embodiment, the electronic processor may provide electrical power to detectors 21, 22. In another embodiment, either or both of detectors 21 and 22 may send a different signal for each of several operating modes. Operating modes may include (1) normal operating condition, (2) system failure, (3) radiation source identified, and (4) ignition source identified. A system failure may include a no power state or a broken state.

If either or both of detectors 21 or 22 detects radiation consistent with an ignition source, either or both detectors 21, 22 may make a decision to identify to the processor 10 that a hazardous event has occurred, and may accordingly send a digital signal to electronic processor 10. In one embodiment, the electronic processor 10 does not process raw opto-electronic response data or a simple analog signal to interpret whether a hazardous event has occurred; rather, the decision whether a hazardous event has occurred is made exclusively at one or more detectors 21, 22. In one embodiment, either or both of detectors 21 or 22 sends a first signal to the electronic processor 10 before either or both of detectors 21 or 22 detects radiation consistent with an ignition source. A second signal may be sent to the electronic processor 10 after one or both detectors 21, 22 detects radiation consistent with an ignition source.

Electronic processor 10 may receive this first or second signal and take appropriate action, based on its programming. If the detected radiation exceeds a predetermined level as determined by one or more detectors 21, 22, electronic processor 10 may perform one or more of the following acts: send a signal causing valve 31 to open; send a signal causing flow in container C to be diverted to a non-hazardous location where the presence of an ignition source may be acceptable; activate a process shut down to cut off flow F and/or the supply of an air flow; activate inertion or extinguishing equipment; activate an explosion suppression system; record a time and date stamp of the detection event; send an alarm signal to monitor 60; cause audible alarm 51 to emit a warning sound; and activate visual alarm 52. Depending on the wavelength of the radiation as defected by the detectors 21, 22, the time since the last potential ignition-source was detected, and other factors, electronic processor 10 may cause only some of the responses mentioned above.

In another embodiment, the electronic processor 10 may provide power to detectors 21 and 22 at a voltage that is modulated between a high voltage and a low voltage with a short and normally controlled time interval. During a normal operating condition, the processor 10 may receive a voltage with a normal modulation and take no action. When either or both of detectors 21 or 22 senses radiation, either or both may make a decision to modify the duration of either the high or low voltage. The electronic processor 10 may be configured to interpret this modification as indicating the presence of a radiation source. In another embodiment, the duration of either the high or low voltage may be extended for a time corresponding to a length of time that a radiation source is detected. According to this embodiment, the electronic processor 10 may be configured to respond to the detected radiation source only when the radiation source is detected for a threshold amount of time. In yet another embodiment, the modulated voltage may take the form of a generally square wave. According to this embodiment, the amount of time between a high voltage and a low voltage may be minimized. An embodiment providing modulated voltage in the form of a generally square wave may allow the electronic processor 10 to make a faster decision in response to detection of radiation.

The electronic processor 10 may interpret these voltage modifications as a radiation detection event. In response, the electronic processor 10 may perform one or more of the following acts: send a signal causing valve 31 to open; send a signal causing flow in container C to be diverted to a non-hazardous location where the presence of an ignition source may be acceptable; activate a process shut down to cut off flow F and/or the supply of an air flow; activate inertion or extinguishing equipment; activate an explosion suppression system; record a time and date stamp of the detection event; send an alarm signal to monitor 60; cause audible alarm 51 to emit a warning sound; and activate visual alarm 52. Depending on the wavelength of the radiation as detected by the detectors 21, 22, the time since the last potential ignition-source was detected, and other factors, electronic processor 10 may cause only some of the responses mentioned above.

In an embodiment where electronic processor 10 is configured to signal valve 31 to open, nozzle 30 may be placed downstream from detectors 21, 22 in the direction of flow F. The distance between nozzle 30 and detectors 21, 22 may depend on the response time of the system, response time being the time between detection of a radiation source and the spray S released by opening of valve 31 becoming established throughout a cross section of container C. According to one embodiment of the system, response time is between 160 milliseconds and 250 milliseconds. In one embodiment, where a water supply pressure is 100 psi/7 bar, one meter of a duct of 40-inches diameter is spray protected within 200 milliseconds from detection of a radiation source. In another embodiment, where a water supply pressure is 100 psi/7 bar, one meter of a duct of 40-inches diameter is spray protected within 180 milliseconds from detection of a radiation source. In still another embodiment, where a water supply pressure is 100 psi/7 bar, one meter of a duct of 40-inches diameter is spray protected within 160 milliseconds from detection of a radiation source.

Opening valve 31 allows a fluid stored in reservoir 40 to pass through nozzle 30, forming a spray S inside of container C. When sprayed into container C, the fluid, known as a "quenching medium," prevents ignition. Conventional systems typically use water or carbon dioxide as the quenching medium; however, any suitable quenching medium may be used with an embodiment of the system.

Supply line 34 connects reservoir 40 to valve 31 to convey the stored fluid to nozzle 30. In one embodiment, a shut-off valve 32 and filter 33 are positioned between reservoir 40 and nozzle 30. In some systems, a single assembly contains nozzle 30, valve 31, filter 33, and shut-off valve 32. Reservoir 40 may include a pump 41, configured to maintain a desired quenching medium quantity and pressure in supply line 34. When the quenching medium is water, ignition-source detecting system 100 may also monitor a heat tracing circuit 42, designed to prevent freezing in cold climates.

Container C may be any container or confined space, such as a dust collector, air filter, pneumatic conveyor, duct, pipeline, or the like. Particles P may include dust from an industrial or agricultural application, such as, for example, metal processing, wood working, manufacturing processes, or grain storage. In some applications, particles P may move through container C in flow direction F.

As mentioned above, detectors 21, 22 may be mounted on container C in a manner that enables the detectors to detect radiation released by any potential ignition sources within container C.

Ignition source detection system 100 may also be applied to an open processing system such as a conveyor with detectors 21, 22 mounted to survey the stream of bulk material moving past their field of view.

Figure 5:
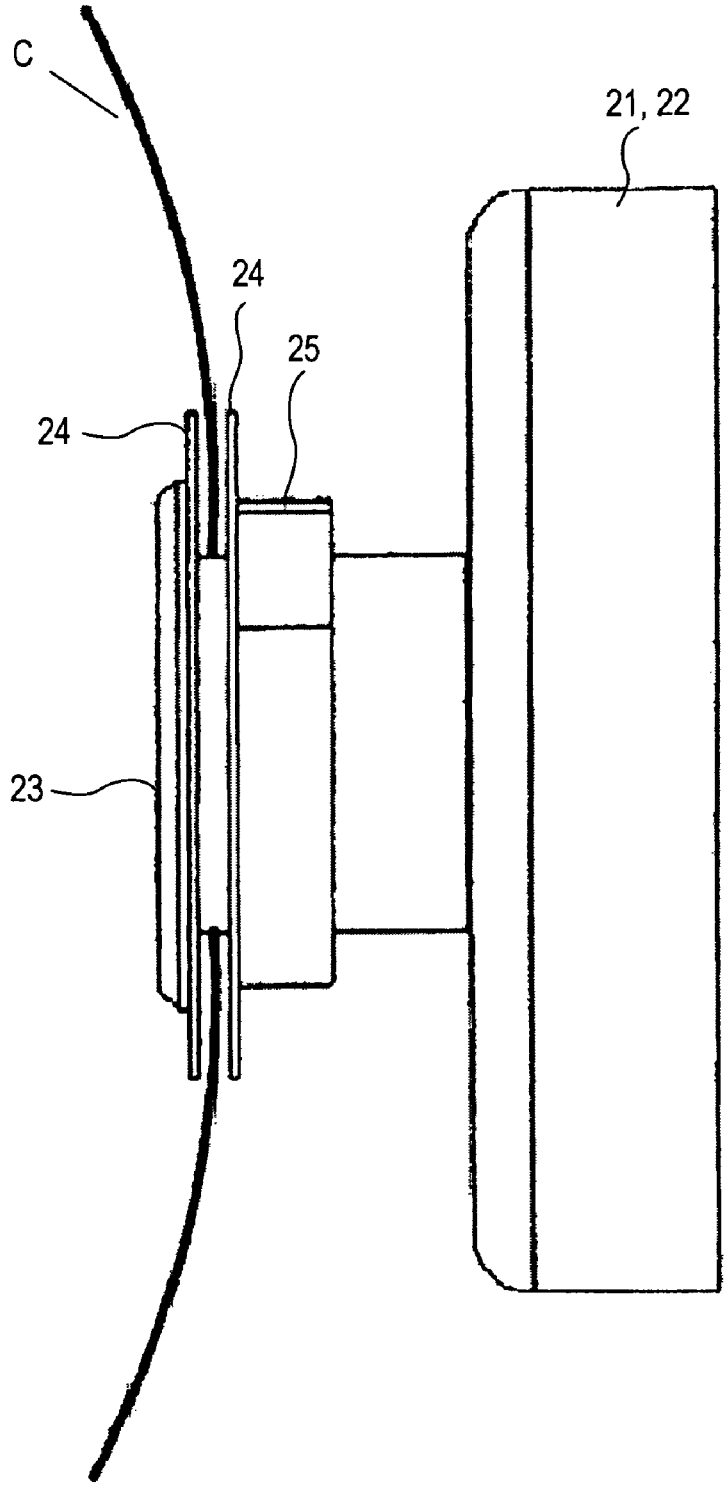
FIG. 5 is a diagram of a detector mounted on a container, for use in an exemplary embodiment of the ignition-source detecting system.
Figure 6:
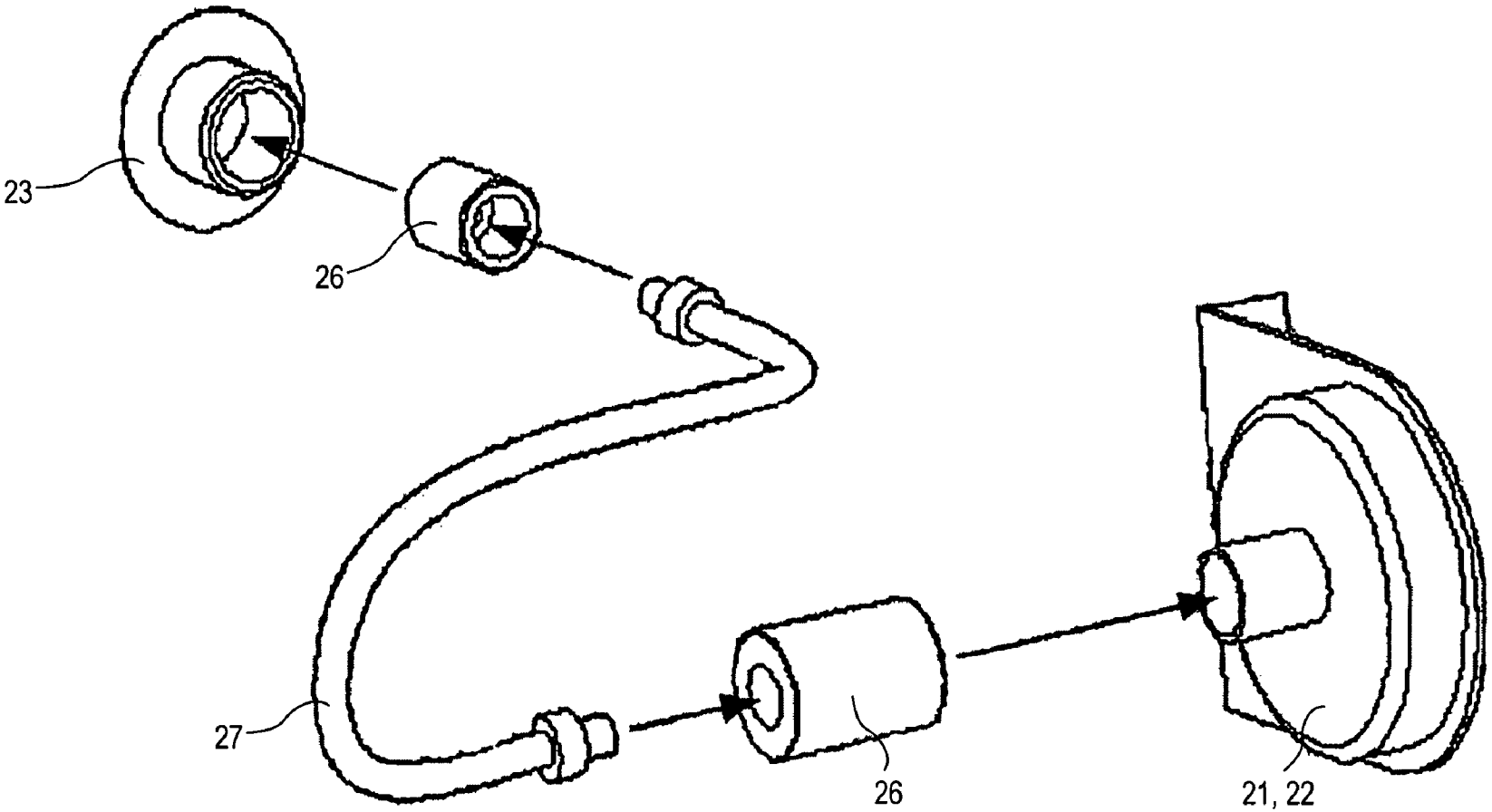
FIG. 6 is a perspective view of a detector configured to be mounted distally from the container, for use in an exemplary embodiment of the ignition-source detecting system.

In one embodiment, each of detectors 21, 22 may attach to the exterior of container C by a detector adapter 23 separating it from the interior of container C. According to an embodiment illustrated in FIG. 5, each of detectors 21, 22 sits on the exterior of container C with a detector adapter 23. In this embodiment, detector adapter 23 is held in place with rings 24 and nut 25. However, any suitable method of attaching detector adapter may be used. In some cases it may be desirable to situate detectors 21, 22 distal from the surface of container C. Accordingly, in one embodiment, shown in FIG. 6, the system may include two optical fiber adapters 26 that attach detector adapter 23 and distal detector 21 or 22 via an optical fiber 27. Adapters 23 may include windows (not shown), made of sapphire glass or other scratch resistant and optically clear material. These windows ensure that none of particles P escape container C, while giving detectors 21, 22 a clear view of the interior of container C. In one embodiment, detectors 21 and 22 may be rated for use in an electrical hazard zone, and windows provide an additional safety barrier for the detectors 21, 22. In another embodiment, these adapters are installed using left-handed and right-handed threads. Using both right-handed and left-handed screws avoids inadvertent loosening of one threaded connection while trying to secure another. Finally, the adapters on which detectors 21, 22 are mounted may include an integral air cleaning groove (not shown) to flush accumulated particles from the process side of the window.

In one embodiment, detectors 21, 22 may be push-fit in place, allowing for a simple running change of a damaged detector while the ignition-source detecting system 100 remains active. In this manner, the replacement of a detector does not interrupt the flow of particles P through container C, as the underlying adapter maintains the seal of container C. In another embodiment, detectors 21, 22 may be mounted by use of a sanitary flange and clamp arrangement.

Detectors 21, 22 may be placed in a dark environment or in a daylight environment. If placed in daylight, each of detectors 21, 22 may include a filter or other means of eliminating daytime radiation that would otherwise trip the detector. Detectors 21, 22 may be configured to be placed in a dust hazard environment; such as "ATEX Zone 21" or "ATEX Zone 22," or "Class 2 Division 1" or "Class 2 Division 2" environments as specified in North American electrical codes. Detectors 21, 22 may alternatively be configured to be placed in a gas hazard environment such as NEC class C1D1, NEC class C1D2, ATEX zone 1, or ATEX zone 2.

Detectors 21, 22 can be adjusted for sensitivity either before, after, or during use or installation. This ability allows detectors 21, 22 to be calibrated to detect low temperature hot material not normally visible in conventional ignition-source detecting systems, but still capable of igniting particles P. Detectors 21, 22 output a direct digital signal when they detect radiation of a preselected wavelength. According to one embodiment of the system, detectors 21, 22 may be configured to detect radiation in the infrared portion of the spectrum. Another embodiment may include detectors configured to detect ultraviolet radiation; temperature; gas characteristics, including gas composition, concentration of oxygen, concentration of carbon monoxide, and content of hazardous trace gases; and motion. In some configurations, it is possible for detectors 21, 22 to sense radiation over two or more different ranges of wavelengths. The ranges selected for detectors 21, 22 may—but do not have to—overlap.

In one embodiment, each of detectors 21, 22 may emit a periodic test signal from a light emitting diode (LED) that may be integral to the detector. By emitting this test signal, the detector 21, 22 allows ignition-source detecting system 100 to perform an optical and sensing circuit check. In one embodiment, the LED emits light for a very short time, less than the time for a glowing particle to pass by a detector in container C. The electronic processor ignores this test signal, ensuring that no fluid is released from spray nozzle 30. This self-testing, therefore, does not affect the efficacy of the system. In an embodiment where detectors 21 and 22 have overlapping fields of vision, the overlap ensures that one detector may continue to monitor the container while the other is performing an optical and sensing circuit check.

Electronic processor 10 may include a keypad 11, an indicator light 12, and a connection terminal 15, including multiple dip switches 16. In one embodiment, the electronic processor 10 may be a microprocessor, ensuring fast decisions are taken when detectors 21, 22 detect a hazardous event.

Connection terminal 15 may connect electronic processor 10 to the other components included in ignition-source detecting system 100. Specifically, connection terminal 15 may accept dedicated wires running to detectors 21, 22, valve 31, audible alarm 51, and visual alarm 52. In one embodiment, a data cable connects connection terminal 15 with monitor 60 to allow use of a communications bus. If desired, any of these components may be switched from wire-based communication protocols to cable-based communication protocols taking advantage of the communications bus. Additionally, communication between monitor 60 and electronic processor 10 may be wireless. In another embodiment, connection terminal 15 may connect to a central control system such as a DCS, allowing remote monitoring of the system 100. Whether wire-based, cable-based, or wireless, the communication between monitor 60 and electronic processor 10 may take the form of discrete digital messaging, analog data, or a combination of digital and analog data.

In one embodiment, electronic processor 10 is field mounted. In other words, electronic processor 10 may be located in close proximity to container C, detectors 21, 22, valve 31, and spray nozzle 30. In one embodiment, the electronic processor 10 may be mounted within the same hazardous environment as container C, detectors 21, 22, valve 31, and spray nozzle 30. The same hazardous environment may be an environment classified as: ATEX Zone 21 or ATEX Zone 22; ATEX Zone 1 or ATEX Zone 2; or NEC class C2D1, NEC class C2D2, NEC class C1D1, or NEC class C1D2. In another embodiment, the electronic processor 10 may be mounted on or adjacent to container C. This close proximity differentiates ignition-source detecting systems 100 from conventional systems, which typically include a centrally mounted control system. Mounting electronic processor 10 in close proximity to the other system components provides the shortest distance for wiring between components, lessening the risk of their being cut or damaged. Minimizing the length of wires between the components of ignition-source detecting system 100 also reduces installation costs by using fewer materials and easing installation.

Figure 4:
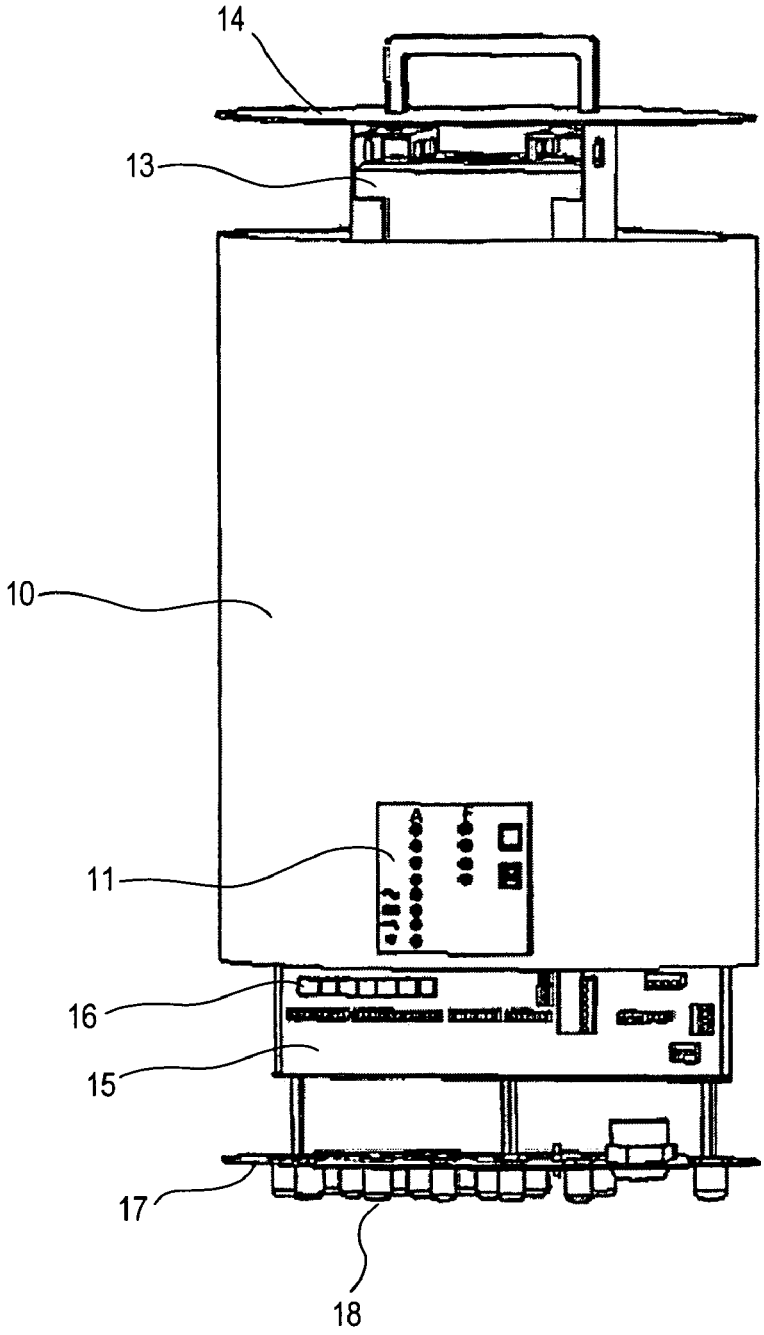
FIG. 4 is a perspective view of an electronic processor for use in an ignition-source detecting system according to an exemplary embodiment.

Detectors 21, 22, valve 31, audible alarm 51, and visual alarm 52 may all connect to electronic processor 10 via connection terminal 15. By setting dip switches 16 on connection terminal 15, a user can configure electronic processor 10 as desired. Dip switches provide a relatively simple method of configuring the electronic processor, making the use of ignition-source detecting system 100 less taxing on users. In one embodiment, the use of dip switches 16 may avoid the need for the system 100 to be connected to a laptop, PC, or other external device to configure the electronic processor 10 logic. As shown in FIG. 4, dip switches 16 and connection terminal 15 may be sealed within the housing of the electronic processor 10 behind an enclosing end plate 17. So enclosed, connection terminal 15 may connect to external components through wiring connections 18 on end plate 17.

Keypad 11 and indicator light 12 allow users to monitor the operation of electronic processor 10 locally. Local monitoring may allow for quicker on-site user response to the detection of a hazardous condition. In one embodiment, keypad 11 may include a pictogram of operating controls and alarm status annunciation. Using pictograms may eliminate any language barriers that might arise with written displays. The keypad may have indicators for the status of at least the following functions: ignition-source detection/extinguishing activation; ignition-source indicator status; fluid supply status; main power supply status; back-up power supply status; and status of spray nozzle heat tracing (if equipped).

Figure 7:
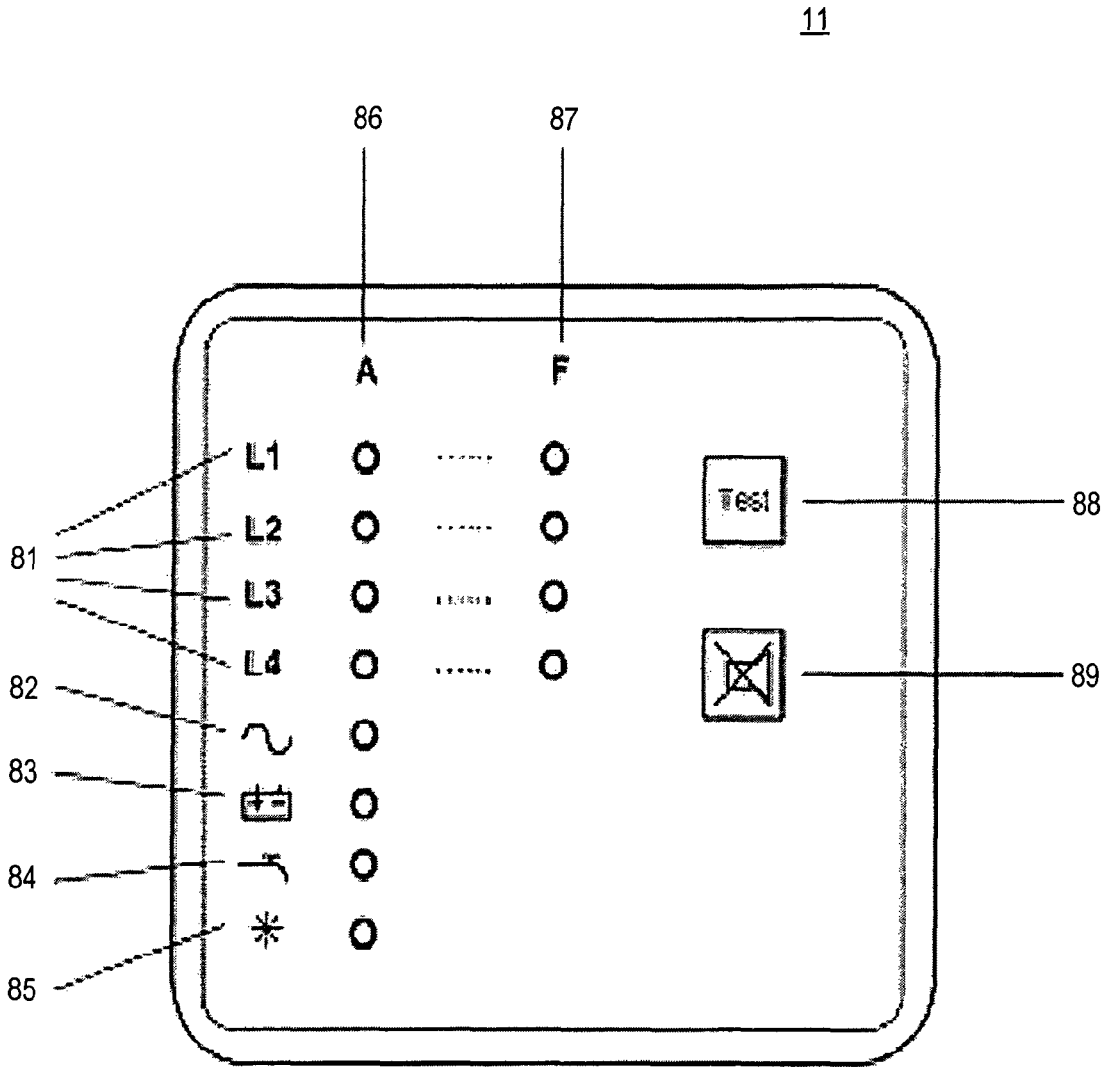
FIG. 7 is a diagram of a keypad for an electronic processor suitable for use in an exemplary embodiment of the ignition-source detecting system.

In certain embodiments, indicator light 12 may comprise a light emitting diode (LED). With this configuration, it is possible to use color coding (green="OK"/red="alarm") to ease operator understanding. While a single indicator light 12 is illustrated in FIG. 1, some embodiments may include multiple indicator lights, either as a part of keypad 11 or disposed separately on electronic processor 10. In the embodiment illustrated in FIG. 7, for example, keypad 11 includes multiple LED's 86 configured to indicate the following: whether an alarm has been triggered for any of multiple detectors 81, main power supply status 82, back-up power supply status 83, water supply status 84, and trace heating status 85. Additionally, keypad 11 may include multiple LED's 87 configured to indicate whether a fault has been detected in any of multiple detectors 81.

Local monitoring of electronic processor 10 may be particularly desirable when the electronic processor is used as the sole system monitor. Accordingly, one embodiment provides a simple user interface to accept user input on the keypad 11. In one embodiment, user input is accomplished through two switches 88 and 89. A first switch, 88, may be used to manually test the system at any time, and may be used to reset the system after activation or a system status alarm is corrected. A second switch, 89, may be used to mute or cancel an alarm. In another embodiment, switches 88 and 89 are the only switches on the user interface of keypad 11.

To reduce the costs associated with field mounting, electronic processor 10 may have a compact profile. Moreover, electronic processor 10 may have a modular design, allowing it to manage multiple detectors 21, 22 and multiple spray nozzles 30. Only one electronic processor 10 may be needed to support a single or multiple points of application in certain embodiments.

Electronic processor 10 could be used to trigger various measures when an ignition source is detected. FIG. 1 depicts a system including a spray nozzle 30, which releases a fluid intended to stop ignition. In addition to or instead of such a spray nozzle 30, however, electronic processor 10 could control a diverter valve, a fire-protection system, process shut down, or a fast-closing valve.

Detectors 21 and 22 may be configured to detect flames, as well as other ignition sources, such as sparks and embers. If this is the case, detectors 21, 22 may be configured to output a direct digital signal to equipment or systems other than electronic processor 10. Alternatively, electronic processor 10 may receive a digital signal from one or both of detectors 21 or 22, determine that the detector or detectors have detected a flame, and send a direct digital signal to another system, processor, or piece of equipment. If desired, however, the detection of a flame may create a response by ignition-source detecting system 100 itself, without the inclusion of additional equipment or systems.

Notably, electronic processor 10 may include a microprocessor, ensuring fast response times and allowing a user to customize ignition-source detecting system 100. By reprogramming electronic processor 10, for example, the user can set desired outcomes, alarm set points, and other parameters. Programming may be achieved via keypad 11 and/or dip switches 16 or may require reprogramming of the electronic processor 10 to assign new functions to certain keypads 11 and dip switches 16.

The control units in conventional ignition-source detecting systems, unlike ignition-source detecting system 100, depend on mechanical or solid state relays to process signals received from detectors. The rigid electrical design included in conventional control units severely limits the ability to change or customize system operation. Indeed, changing the logic by which conventional systems operate requires adjustment or replacement of the relays that they include. In ignition-source detecting system 100, however, electronic processor 10 may be configured with no relays. Accordingly, the supplier of the ignition-source detection system can easily modify the manner in which electronic processor 10 operates and the user can easily modify the manner in which ignition source detecting system 100 operates.

Like detectors 21, 22, electronic processor 10 may be configured for mounting in a dust hazard environment, such as "ATEX Zone 21" or "NEC Class 2 Division 1" environments. This allows the mounting of electronic processor 10 in close proximity to the other components of ignition-source detecting system 100, lowering the chances of unintentional signal interruption and reducing installation costs. Conventional ignition-source detection systems, on the other hand, typically require a combined controller and monitor to be in a lower-hazard-level dusty environment such as "ATEX Zone 22," "NEC Class 2 Division 2," or unrated.

During operation, electronic processor 10 may include a programmable two-level alarm structure. Specifically, electronic processor 10 may initiate a local alarm at the electronic processor every time it detects a potential ignition source. If electronic processor 10 detects a series of ignition sources, however, it may initiate both a local alarm and a process shutdown circuit. The programmability of electronic processor 10 allows users to fine tune this second-level alarm to the process or application being monitored to avoid unnecessary shut down. In one embodiment of the system, the second-level alarm may be fine-tuned to include a time threshold—if ignition sources continue to be detected for the duration of the time threshold, then the second-level alarm will be triggered.

If ignition-source detecting system 100 includes an independently powered heat tracing circuit 42, electronic processor 10 may monitor the flow of electricity of the heat tracing circuit. Ignition-source detecting systems used in cold climates typically include a heat tracing circuit and insulation to prevent freezing if a water spray system is used. Such heat tracing systems include wires having relatively high resistance, configured to generate heat as electricity flows through them. By winding the wires of the heat tracing system around components carrying water, the heat tracing system can prevent the water from freezing. Electronic processor 10 may be configured to raise an alarm if heat tracing system 41 loses electrical power.

In one embodiment, electronic processor 10 includes an integral back-up power supply, enabling the ignition-source detection system 100 to function fully. In this manner, a temporary power failure will not create vulnerability to fire or explosion. According to one embodiment, illustrated in FIG. 4, integral back-up power supply may include a battery (not shown). Battery holder 13 holds battery, while battery holder plate 14 secures battery and battery holder 13 within control unit housing 10.

Valve 31 may open and close in response to electronic signals received from electronic processor 10. In one embodiment, valve 31 may be a fast-acting solenoid valve, allowing for the release of fluid very soon after detection of an ignition source.

Figure 2:
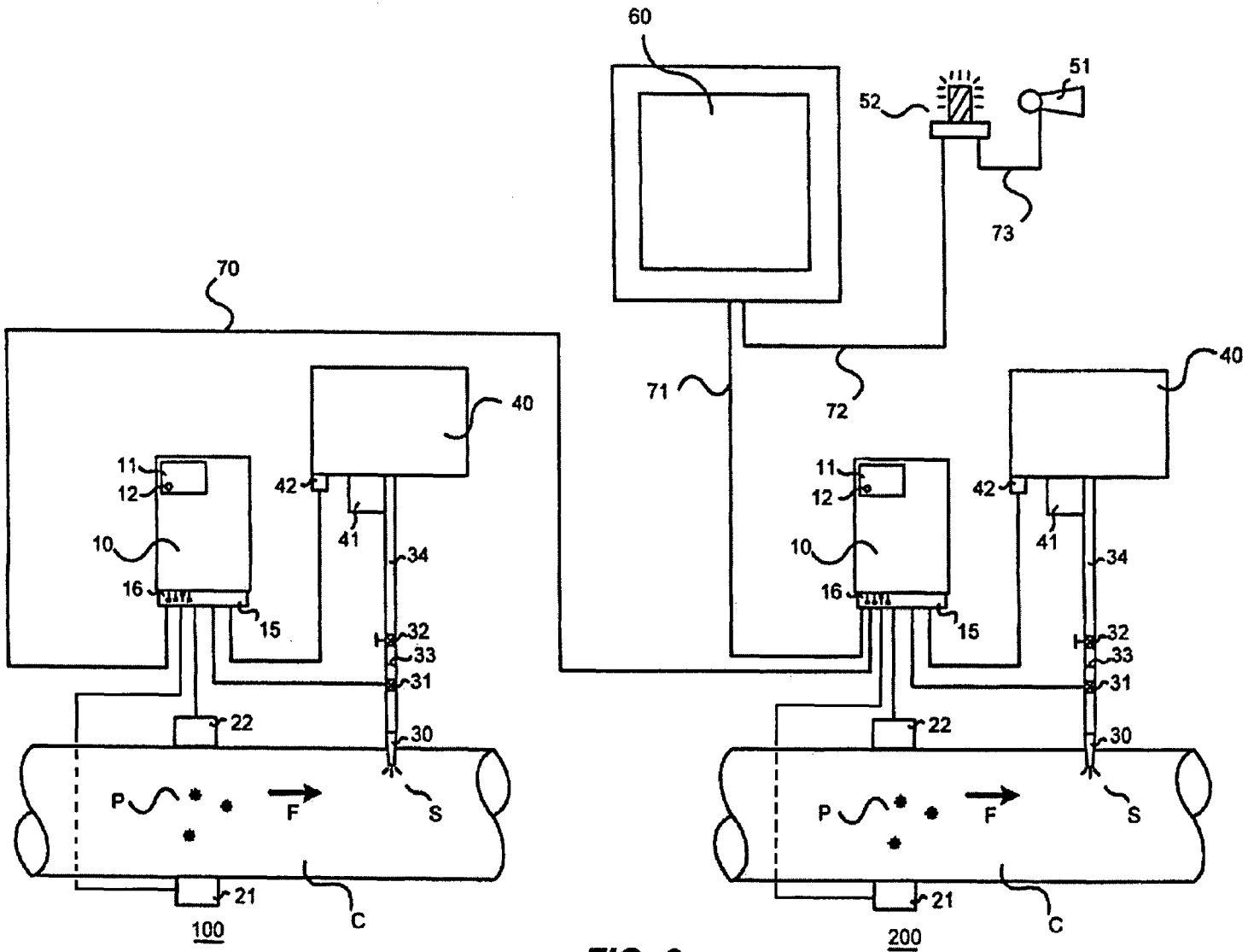
FIG. 2 is a schematic diagram of two ignition-source detecting systems according to an exemplary embodiment.

FIG. 2 shows two identical ignition-source detection systems 100, 200 coupled together in a network. Each of ignition-source detection systems 100, 200 includes an electronic processor 10, detectors 21 and 22, a nozzle 30, and a valve 31. The two ignition-source detection systems 100, 200 share a common monitor 60, audible alarm 51, and visual alarm 52. Data cables 70, 71, 72, and 73 connect ignition-source detection systems 100, 200 to these components.

While the ignition-source detection systems 100, 200 communicate with one another, each operates as a self-contained unit at system level. If one of ignition-source detection systems 100, 200 fails, this failure does not affect the ignition-source detection systems on the network. For each ignition-source detection system 100, 200, all system decisions may be made at that system's electronic processor 10, not at a central controller.

In one embodiment, a communications bus, such as a CAN-bus interface connection, allows each electronic processor 10 to communicate with other ignition-source detector systems and/or a central monitor, as illustrated in FIG. 2. CAN-bus is a "freeware" communications protocol, but other, proprietary, protocols could be incorporated into ignition-source detecting systems 100, 200.

Using a communications bus allows a single data cable 70 to tie ignition-source detection systems 100, 200 together. While FIG. 2 shows only two ignition-source detection systems 100, 200, additional systems could be added, at the user's discretion.

The communications bus permits a single central monitor 60 to communicate with all connected ignition-source detecting systems 100, 200 via a single data cable 71. When additional ignition-source detecting systems are added, the central monitor 60 may automatically detect them. A user then inputs an address for the newly added ignition-source detecting system or systems, allowing monitor 60 to display information regarding the newly added system or systems. Monitor 60 may provide information including the following: visual alarm and fault indication, output of data and current status, and menu-guided operation. In addition, monitor 60 may provide an interface allowing cancellation of an alarm condition of an electronic processor 10. Monitor 60 may also create a data log of system events or provide remote alerts via a modem connection.

Unlike conventional ignition-source detection systems, which use a combined controller and monitor with hard wiring running from each detector and spray nozzle (or other device) back to this combined unit, the configuration illustrated in FIG. 2 includes multiple electronic processors 10. Each of these electronic processors 10 is connected to external or remote monitor 60 using the bus system. This configuration avoids the complexity, expense, and risk of multiple wires.

Conventional ignition-source detection systems typically rely on a central controller having a small number of connection points, limiting the ability to add desired ignition-source detection points to a container or process. Using multiple independent ignition-source detection systems—such as ignition-source detection systems 100, 200—connected via a communications bus avoids this problem. As illustrated in FIG. 2, multiple ignition-source detection systems may be connected to monitor 60, adding detection points as desired. In some configurations, over 1000 individual ignition-source detection systems could report to monitor 60. Moreover, additional remote monitors can be added to the same bus link, if desired.

More than one monitor can be attached to the same multiple system data cable. If desired, using multiple monitors enables users to access system information at various locations. Users may desire, for example, to access system information at locations both near and far from the monitored container. Using multiple monitors allows such a configuration.

Alternatively, central monitoring can be achieved using a hub-and-spoke configuration. In such a configuration, a central monitor is directly connected to multiple ignition-source detecting systems. Each ignition-source detecting system has its own dedicated communications cable connecting it with the central monitor.

Figure 3:
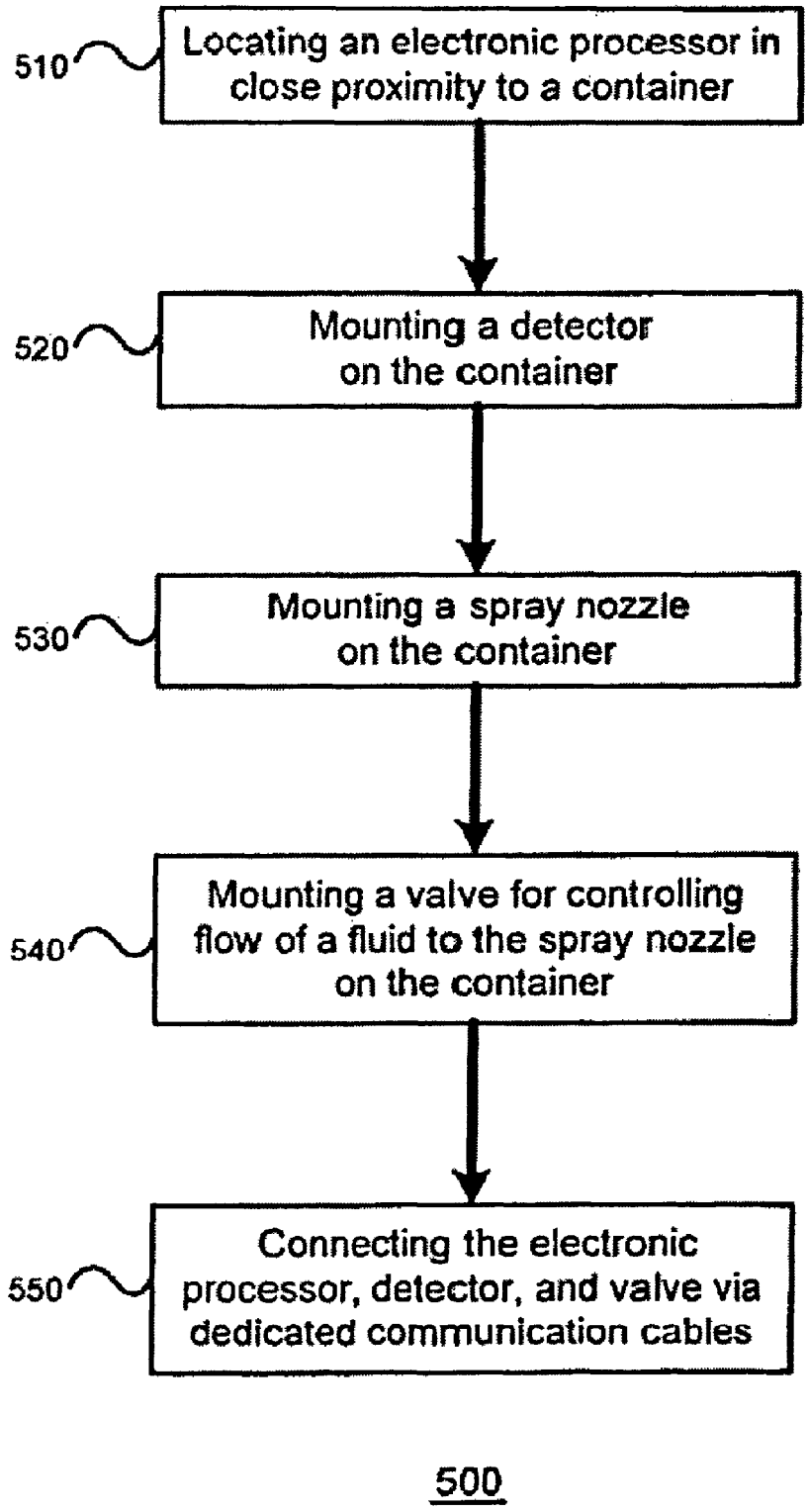
FIG. 3 is a flow chart of a method of installing an ignition-source detecting system according to an exemplary embodiment.

FIG. 3 illustrates an exemplary method of installing a ignition-source detecting system. The method includes the steps of locating an electronic processor in close proximity to a container; mounting a detector on or nearby the container; mounting a spray nozzle on the container; mounting a valve for controlling flow of the fluid to the spray nozzle on the container; and connecting the electronic processor, detector, and valve via dedicated communication cables.

Step 510 comprises locating an electronic processor in close proximity to a container. As discussed above, mounting an electronic processor in close proximity to the container that an ignition-source detecting system will monitor reduces the amount of wires and cables necessary to complete the system. This, in turn, lowers costs and enhances system reliability. Accordingly, step 510 may also include locating the electronic processor in a position that minimizes the distance between the processor, a detector, and a valve. In some methods, the electronic processor is physically mounted on the container, further limiting the amount of connecting wires required.

Mounting step 510 may include mounting the electronic processor in a dust-hazard environment. In such a method, the electronic processor is specifically configured to operate in a dust-hazard environment. This may require specific testing and design decisions.

Mounting step 510 may further comprise setting dip switches disposed on the electronic processor to configure the ignition-source detecting system. Setting dip switches may program the ignition-source detecting system in a manner desired by the user. For example, the user may set dip switches to adjust the wavelength of radiation that will trigger an alarm or to alter the sensitivity of the system before generating a shut down alarm, or to identify the number of active detectors in system 100.

Timers may be incorporated to allow tuning of the system with regard to the amount of extinguishing medium released, the duration of radiation observation required to trigger system alarms, or the time that should pass after detection and before release of extinguishing medium.

The next step of method 500, step 520, includes mounting a detector on the container. Again, the container may be located in a dust-hazard environment, requiring the selection or design of a detector robust enough to withstand the local environment. Step 520 may also comprise configuring the detector to detect radiation within a predetermined range of wavelengths.

Next, in step 530, the method calls for mounting a spray nozzle on the container. The spray nozzle may be configured to spray a fluid into the container. The fluid may be water, carbon dioxide, or another fluid used to prevent ignition of particulate matter or to quench flame arising after ignition.

Step 540 comprises mounting a valve for controlling flow of the fluid to the spray nozzle on the container. The valve may be selected to respond to an electronic signal received from the electronic processor.

Finally, step 550 comprises connecting the electronic processor, detector, and valve via dedicated communication cables. In one embodiment, the overall length of the communication cables between these components is minimized.

Method 500 may also include a step of connecting a monitor to the electronic processor via a dedicated communication cable, the monitor being remote from the container. In one embodiment, the connection may be made using a communications bus, as described in connection with the ignition-source detecting systems mentioned above. This allows users to monitor the detection of ignition sources at a distance from the container. A user may also connect the electronic processor to a second electronic processor via a communications bus.

It will be apparent to those skilled in the art that various modifications and variations can be made in the exemplary apparatus and methods explained above without departing from the scope or spirit of the disclosure.

Other embodiments consistent with the disclosure will be apparent to those skilled in the art from consideration of the specification and practice of the disclosed systems herein. It is intended that the specification and examples be considered as exemplary only, with a true scope and spirit of the disclosure being indicated by the following claims.

What is claimed is:

1. An ignition-source detecting system comprising:

an electronic processor configured to control the ignition-source detecting system; and at least one detector configured to detect radiation in a container, the at least one detector configured to output a modulated voltage having a high voltage and a low voltage.

2. The ignition-source detecting system recited in claim 1, further comprising:

at least one spray nozzle configured to release a fluid; and at least one valve configured to control flow of the fluid to the spray nozzle in response to a signal received from the electronic processor.

3. The ignition-source detecting system recited in claim 1, wherein the electronic processor is mounted on the container.

4. The ignition-source detecting system recited in claim 1, wherein the electronic processor can be programmed.

5. The ignition-source detecting system recited in claim 1, wherein the electronic processor contains no mechanical or solid state relays.

6. The ignition-source detecting system recited in claim 1, wherein the electronic processor includes dip switches for configuring the ignition-source detecting system.

7. The ignition-source detecting system recited in claim 1, wherein the electronic processor includes a communications bus.

8. The ignition-source detecting system recited in claim 7, wherein the ignition-source detecting system is a first ignition-source detecting system and the electronic processor of the first ignition-source detecting system communicates with a remote monitor via the communications bus.

9. The ignition-source detecting system recited in claim 8, wherein the remote monitor is configured to perform at least one of the following functions: indicate a status of the electronic processor, cancel an alarm condition of the electronic processor, and log data generated by the electronic processor.

10. The ignition-source detecting system recited in claim 8, wherein a plurality of ignition-source detection systems communicates with the remote monitor, the monitor being configured to display information from one or all of the ignition-source detection systems.

11. The ignition-source detecting system recited in claim 8, wherein the monitor communicates with the electronic processor of the first ignition-source detecting system via a first dedicated cable with no intervening components and the monitor communicates with the electronic processor of a second ignition-source detecting system through the first dedicated cable.

12. The ignition-source detecting system recited in claim 8, wherein the electronic processor of the first ignition-source detecting system communicates with an electronic processor of a second ignition-source detecting system via a dedicated cable with no intervening components.

13. The ignition-source detecting system recited in claim 2, wherein the container has an upstream section and a downstream section;

the at least one detector is located at the upstream section of the container; and the at least one spray nozzle is located at the downstream section of the container.

14. The ignition-source detecting system recited in claim 1, further comprising:

a keypad mounted on the electronic processor.

15. The ignition-source detecting system recited in claim 14, wherein the keypad contains a first switch and a second switch;

the first switch being configured to initiate a test or reset of the system; and the second switch being configured to mute or cancel an alarm triggered by the system.

16. The ignition-source detecting system recited in claim 1, wherein the at least one detector is further configured to detect a flame.

17. The ignition-source detecting system recited in claim 15, further comprising a device configured to extinguish a flame.

18. The ignition-source detecting system recited in claim 1, wherein the radiation in a container is one of infrared radiation or ultraviolet radiation.

19. The ignition-source detecting system recited in claim 1, wherein the at least one detector is configured to detect at least one of temperature, gas characteristics, and motion.

20. The ignition-source detecting system recited in claim 1, wherein the electronic processor is configured to be disposed in a hazard environment.

21. The ignition-source detecting system recited in claim 20, wherein:

the hazard environment is one defined as ATEX Zone 21 or ATEX Zone 22; ATEX Zone 1 or ATEX Zone 2; or NEC class C2D1, NEC class C2D2, NEC class C1D1, or NEC class C1D2.

22. The ignition-source detecting system recited in claim 1, wherein the at least one detector can be adjusted for sensitivity before, after, or during use or installation.

23. The ignition-source detecting system recited in claim 1, wherein the at least one detector is configured to sense radiation released by a low temperature hot material.

24. The ignition-source detecting system recited in claim 1, wherein the at least one detector is a first detector and the ignition-source detecting system further comprises a second detector.

25. The ignition-source detecting system recited in claim 24, wherein the first detector is configured to detect radiation having a first range of wavelengths;

the second detector is configured to detect radiation having a second range of wavelengths; and the first and second ranges of wavelengths are different.

26. The ignition-source detecting system recited in claim 25, wherein the first and second ranges of wavelengths overlap.

27. The ignition-source detecting system recited in claim 1, wherein the at least one detector is configured to output the modulated voltage before detecting radiation.

28. The ignition-source detecting system recited in claim 27, wherein the modulated voltage has the high voltage before detecting radiation, and the at least one detector is configured to change the modulated voltage to the low voltage after detecting radiation.

29. The ignition-source detecting system recited in claim 28, wherein the at least one detector is further configured to change the modulated voltage after detecting a system failure.

30. The ignition-source detecting system recited in claim 1, further comprising a heat tracing circuit.

31. The ignition-source detecting system recited in claim 30, wherein the electronic processor is configured to monitor the heat tracing circuit; and the electronic processor is configured to raise an alarm if the heat tracing circuit stops receiving electricity.

32. The ignition-source detecting system recited in claim 1, further comprising:

a primary power source; and a secondary power source, wherein the secondary power source is independent from the primary power source.

33. The ignition-source detecting system recited in claim 32, wherein the secondary power source is a battery connected to the electronic processor.

34. The ignition-source detecting system recited in claim 1, further comprising a light emitting diode (LED) configured to generate a test signal.

35. The ignition-source detecting system recited in claim 34, wherein the light emitting diode (LED) is part of the detector.

36. The ignition-source detecting system recited in claim 1, wherein the modulated voltage is a first modulated voltage, wherein the at least one detector is configured to transmit the first modulated voltage for a normal system operating condition, and wherein the at least one detector is further configured to transmit a second modulated voltage for a system interruption condition and a third modulated voltage for an ignition source identified condition.

37. The ignition-source detecting system recited in claim 1, wherein the system has a response time within the range of 160 milliseconds and 250 milliseconds.

38. The ignition-source detecting system recited in claim 1, wherein the system has a response time of 160 milliseconds or less.

39. The ignition-source detecting system recited in claim 1, wherein the system has a response time of 180 milliseconds or less.

40. The ignition-source detecting system recited in claim 1, wherein the system has a response time of 200 milliseconds or less.

41. A method of installing an ignition-source detecting system, comprising:

locating an electronic processor in close proximity to a container;

mounting a detector on the container, the detector being configured to detect radiation in a container, the detector further configured to output a modulated signal having a high voltage and a low voltage; and connecting the electronic processor and detector via dedicated wires.

42. The method of installing an ignition-source detecting system recited in claim 41, further comprising:

mounting a spray nozzle on the container;

mounting a valve for controlling flow of a fluid to the spray nozzle on the container; and connecting the electronic processor, detector, and valve via dedicated wires.

43. The method of installing an ignition-source detecting system recited in claim 42, further comprising mounting the electronic processor on the container.

44. The method of installing an ignition-source detecting system recited in claim 42, further comprising mounting the electronic processor in a dust-hazard environment.

45. The method of installing an ignition-source detecting system recited in claim 42, further comprising setting dip switches disposed on the electronic processor to configure the ignition-source detecting system.

46. The method of installing an ignition-source detecting system recited in claim 42, further comprising configuring the detector to detect radiation within a predetermined range of wavelengths.

47. The method of installing an ignition-source detecting system recited in claim 42, further comprising connecting a monitor to the electronic processor via a dedicated communication cable, the monitor being remote from the container.

48. An ignition-source detecting system, comprising:

an electronic processor for controlling the ignition-source detecting system and a detector for detecting radiation, wherein the detector is configured to output a generally square wave signal having a high voltage and a low voltage, the detector further configured to modify the generally square wave signal when radiation is detected, and the electronic processor and detector are designed for positioning in an ATEX Zone 21 or NEC Class 2, Division 1 location.

49. A method of responding to an ignition source, comprising:

sending a modulated voltage to an electronic processor, the modulated voltage having a high voltage and a low voltage;

detecting a source of radiation in a container;

modifying the duration of either the high voltage or the low voltage in response to a detected source of radiation;

sending a signal from the electronic processor to a valve in response to the modified duration; and actuating the valve to release fluid through a spray nozzle.

50. The method of responding to an ignition source recited in claim 49, further comprising monitoring a status of the electronic processor via a remote monitor.

51. The ignition-source detecting system recited in claim 1, wherein the high voltage has a first duration;

the low voltage has a second duration; and the at least one detector is configured to increase one or more of the first duration and the second duration when radiation is detected in the container.

52. The ignition-source detecting system recited in claim 51, wherein the at least one detector is further configured to increase one or more the first duration or the second duration for a time corresponding to a length of time that the radiation is detected in the container.

53. The ignition-source detecting system recited in claim 52, wherein the modulated voltage takes the form of a generally square wave.

54. The ignition-source detecting system recited in claim 27, wherein the modulated voltage has the low voltage before detecting radiation, and the at least one detector is configured to change the modulated voltage to the high voltage after detecting radiation.

55. The ignition-source detecting system recited in claim 54, wherein the at least one detector is further configured to change the modulated voltage after detecting a system failure.

56. The ignition-source detecting system recited in claim 54, wherein the modulated voltage returns to the low voltage when radiation is no longer detected.

57. The ignition-source detecting system recited in claim 54, wherein the high voltage has a fixed duration, after which the modulated voltage returns to the low voltage.

58. The ignition-source detecting system recited in claim 57, wherein the modulated voltage returns to the high voltage.

59. The ignition-source detecting system recited in claim 28, wherein the modulated voltage returns to the high voltage when radiation is no longer detected.

60. The ignition-source detecting system recited in claim 28, wherein the low voltage has a fixed duration, after which the modulated voltage returns to the high voltage.

61. The ignition-source detecting system recited in claim 60, wherein the modulated voltage returns to the low voltage.

62. The method of claim 41, further comprising:

configuring the detector to change the modulated voltage signal from the high voltage to the low voltage when radiation is detected.

63. The method of claim 41, further comprising:

configuring the detector to output the high voltage for a first duration and the low voltage for a second duration.

64. The method of claim 63, further comprising:

configuring the detector to modify one or more of the first duration and second duration when radiation is detected.

65. An ignition-source detecting system comprising:

an electronic processor configured to control the ignition-source detecting system; and at least one detector configured to detect radiation in a container and output a modulated signal to the electronic processor; wherein, the modulated signal has a high value and a low value.

66. The ignition-source detecting system of claim 65, wherein the modulated signal is a modulated voltage signal.

67. The ignition-source detecting system of claim 65, wherein the modulated signal has the high value before radiation is detected, and wherein the detector is configured to change the modulated signal to the low value after radiation is detected.

68. The ignition-source detecting system of claim 65, wherein the modulated signal has the low value before radiation is detected, and wherein the detector is configured to change the modulated signal to the high value after radiation is detected.

69. The ignition-source detecting system of claim 65, wherein the high value has a first duration and the low value has a second duration.

70. The ignition-source detecting system of claim 69, wherein the detector is configured to modify either the first duration or the second duration in response to a detected source of radiation.

* * * * *

UNITED STATES PATENT AND TRADEMARK OFFICE

CERTIFICATE OF CORRECTION

PATENT NO. : 7,843,352 B2
APPLICATION NO. : 12/068956
DATED : November 30, 2010
INVENTOR(S) : Povl Hansen et al.

It is certified that error appears in the above-identified patent and that said Letters Patent is hereby corrected as shown below:

In claim 52, column 17, line 4, “more the first” should read --more of the first--.

Signed and Sealed this
Twenty-second Day of March, 2011

David J. Kappos

David J. Kappos
*Director of the United States Patent and Trademark Office*